US009470043B2

(12) United States Patent
Mourik et al.

(10) Patent No.: US 9,470,043 B2
(45) Date of Patent: Oct. 18, 2016

(54) HIGHLY WEAR RESISTANT DIAMOND INSERT WITH IMPROVED TRANSITION STRUCTURE

(71) Applicant: Smith International, Inc., Houston, TX (US)

(72) Inventors: Nephi M. Mourik, Provo, UT (US); Peter T. Cariveau, Spring, TX (US); Frederico Bellin, The Woodlands, TX (US); Yi Fang, Orem, UT (US)

(73) Assignee: Smith International, Inc., Houston, TX (US)

( * ) Notice: Subject to any disclaimer, the term of this patent is extended or adjusted under 35 U.S.C. 154(b) by 238 days.

(21) Appl. No.: 14/071,277

(22) Filed: Nov. 4, 2013

(65) Prior Publication Data

US 2014/0054095 A1 Feb. 27, 2014

Related U.S. Application Data

(63) Continuation of application No. 12/851,874, filed on Aug. 6, 2012, now Pat. No. 8,573,330.

(60) Provisional application No. 61/232,125, filed on Aug. 7, 2009.

(51) Int. Cl.
*E21B 10/567* (2006.01)
*C22C 26/00* (2006.01)
(Continued)

(52) U.S. Cl.
CPC ..... *E21B 10/567* (2013.01); *C22C 26/00* (2013.01); *E21B 10/36* (2013.01);
(Continued)

(58) Field of Classification Search
CPC ..... E21B 10/55; E21B 2010/5654; E21B 10/567; E21B 10/573; E21B 10/62; B22F 2207/01; B22F 2207/13
See application file for complete search history.

(56) References Cited

U.S. PATENT DOCUMENTS 2,941,241 A 6/1960 Strong
2,941,248 A 6/1960 Hall
(Continued)

FOREIGN PATENT DOCUMENTS

EP 0235455 1/1992
EP 0219959 4/1992
(Continued)

OTHER PUBLICATIONS

International Search Report and Written Opinion of PCT Application No. PCT/US2010/044657 dated Mar. 17, 2011.
(Continued)

*Primary Examiner* — Nicole Coy

(57) ABSTRACT

An insert for a drill bit may include a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least one transition layer between the metallic carbide body and the outer layer, the at least one transition layer comprising a composite of second diamond grains, first metal carbide particles, and a second binder material, wherein the first metal carbide particles form a matrix in which the second diamond grains are dispersed, wherein the first metal carbide particles are present in the at least one transition layer in an amount ranging from about 15 to 50 volume percent.

21 Claims, 3 Drawing Sheets

(51) Int. Cl.
*E21B 10/36* (2006.01)
*E21B 10/55* (2006.01)
*E21B 10/56* (2006.01)

(52) U.S. Cl.
CPC ..... *E21B 10/5673* (2013.01); *B22F 2207/01* (2013.01); *B22F 2207/13* (2013.01); *C22C 2204/00* (2013.01); *E21B 10/55* (2013.01); *E21B 2010/565* (2013.01)

(56) References Cited

U.S. PATENT DOCUMENTS

| | | | | |
|---|---|---|---|---|
| 2,947,611 | A | 8/1960 | Bundy | |
| 3,609,818 | A | 10/1971 | Wentorf, Jr. | |
| 3,767,371 | A | 10/1973 | Wentorf, Jr. et al. | |
| 4,224,380 | A | 9/1980 | Bovenkerk et al. | |
| 4,289,503 | A | 9/1981 | Corrigan | |
| 4,311,490 | A | 1/1982 | Bovenkerk et al. | |
| 4,604,106 | A | 8/1986 | Hall et al. | |
| 4,667,756 | A | 5/1987 | King et al. | |
| 4,673,414 | A | 6/1987 | Lavens et al. | |
| 4,694,918 | A * | 9/1987 | Hall | B22F 7/06 175/414 |
| 4,813,500 | A | 3/1989 | Jones | |
| 4,954,139 | A | 9/1990 | Cerutti | |
| RE33,757 | E | 12/1991 | Weaver | |
| 5,290,507 | A | 3/1994 | Runkle | |
| 5,370,195 | A | 12/1994 | Keshavan et al. | |
| 5,732,783 | A | 3/1998 | Truax et al. | |
| 6,009,962 | A | 1/2000 | Beaton | |
| 6,095,265 | A | 8/2000 | Alsup | |
| 6,193,000 | B1 | 2/2001 | Caraway et al. | |
| 6,199,645 | B1 | 3/2001 | Anderson et al. | |
| 6,241,036 | B1 | 6/2001 | Lovato et al. | |
| 6,290,008 | B1 | 9/2001 | Portwood et al. | |
| 6,296,069 | B1 | 10/2001 | Lamine et al. | |
| 6,371,226 | B1 | 4/2002 | Caraway | |
| 6,375,706 | B2 | 4/2002 | Kembaiyan et al. | |
| 6,443,248 | B2 | 9/2002 | Yong et al. | |
| 6,458,471 | B2 | 10/2002 | Lovato et al. | |
| 6,461,401 | B1 | 10/2002 | Kembaiyan et al. | |
| 6,474,425 | B1 | 11/2002 | Truax et al. | |
| 6,510,906 | B1 | 1/2003 | Richert et al. | |
| 6,651,757 | B2 | 11/2003 | Belnap et al. | |
| 6,725,953 | B2 | 4/2004 | Truax et al. | |
| 6,742,611 | B1 | 6/2004 | Illerhaus et al. | |
| 6,843,333 | B2 | 1/2005 | Richert et al. | |
| 6,951,578 | B1 | 10/2005 | Belnap et al. | |
| 7,234,550 | B2 | 6/2007 | Azar et al. | |
| 7,350,599 | B2 | 4/2008 | Lockwood et al. | |
| 7,350,601 | B2 | 4/2008 | Belnap et al. | |
| 7,377,341 | B2 | 5/2008 | Middlemiss et al. | |
| 7,426,969 | B2 | 9/2008 | Azar | |
| 7,469,757 | B2 | 12/2008 | Azar et al. | |
| 7,497,280 | B2 | 3/2009 | Brackin et al. | |
| 7,533,740 | B2 | 5/2009 | Zhang et al. | |
| 7,757,793 | B2 | 7/2010 | Voronin et al. | |
| 2001/0000101 | A1 | 4/2001 | Lovato et al. | |
| 2001/0002557 | A1 | 6/2001 | Kembaiyan et al. | |
| 2001/0008190 | A1 | 7/2001 | Scott et al. | |
| 2001/0047891 | A1 | 12/2001 | Truax et al. | |
| 2002/0125048 | A1 | 9/2002 | Traux et al. | |
| 2003/0111273 | A1 | 6/2003 | Richert et al. | |
| 2004/0037948 | A1 | 2/2004 | Tank et al. | |
| 2004/0154840 | A1 | 8/2004 | Azar et al. | |
| 2004/0245022 | A1 | 12/2004 | Izaguirre et al. | |
| 2005/0133276 | A1 | 6/2005 | Azar | |
| 2005/0133278 | A1 | 6/2005 | Azar | |
| 2005/0230150 | A1 | 10/2005 | Oldham et al. | |
| 2006/0032677 | A1 | 2/2006 | Azar et al. | |
| 2006/0166615 | A1 | 7/2006 | Tank et al. | |
| 2006/0283637 | A1 | 12/2006 | Viel et al. | |
| 2007/0215389 | A1 | 9/2007 | Da Silva et al. | |
| 2007/0215390 | A1 | 9/2007 | Azar et al. | |
| 2007/0284153 | A1 | 12/2007 | Richert et al. | |
| 2008/0017421 | A1 | 1/2008 | Lockwood | |
| 2008/0073126 | A1 | 3/2008 | Shen et al. | |
| 2008/0128951 | A1 | 6/2008 | Lockwood et al. | |
| 2008/0135306 | A1 | 6/2008 | Da Silva et al. | |
| 2008/0142262 | A1 | 6/2008 | Drivdahl et al. | |
| 2008/0149398 | A1 | 6/2008 | Azar | |
| 2008/0185189 | A1 | 8/2008 | Griffo et al. | |
| 2008/0202821 | A1 | 8/2008 | McClain et al. | |
| 2008/0223623 | A1 | 9/2008 | Keshavan et al. | |
| 2008/0230280 | A1 | 9/2008 | Keshavan et al. | |
| 2008/0282618 | A1 | 11/2008 | Lockwood | |
| 2009/0090563 | A1 | 4/2009 | Voronin et al. | |
| 2009/0095532 | A1 | 4/2009 | Laird et al. | |
| 2009/0107732 | A1 | 4/2009 | McClain et al. | |
| 2009/0120008 | A1 | 5/2009 | Lockwood et al. | |
| 2009/0133938 | A1 | 5/2009 | Hall et al. | |
| 2009/0173547 | A1 | 7/2009 | Voronin et al. | |
| 2009/0273224 | A1 | 11/2009 | Hall | |
| 2010/0014931 | A1 * | 1/2010 | Matthias | B22F 7/08 407/119 |
| 2010/0062253 | A1 | 3/2010 | Egan et al. | |
| 2010/0196717 | A1 | 8/2010 | Liversage et al. | |
| 2010/0236836 | A1 | 9/2010 | Voronin | |
| 2011/0031032 | A1 | 2/2011 | Mourik et al. | |
| 2011/0031033 | A1 | 2/2011 | Mourik et al. | |
| 2011/0031037 | A1 | 2/2011 | Bellin et al. | |
| 2011/0036643 | A1 | 2/2011 | Belnap et al. | |
| 2011/0042147 | A1 | 2/2011 | Fang et al. | |
| 2014/0060938 | A1 | 3/2014 | Bellin et al. | |

FOREIGN PATENT DOCUMENTS

| | | |
|---|---|---|
| EP | 0487355 | 3/1995 |
| EP | 1006257 | 2/2004 |
| EP | 1330323 | 5/2006 |
| WO | 0234437 | 5/2002 |
| WO | 2008076908 | 6/2008 |
| WO | 2010020962 | 2/2010 |

OTHER PUBLICATIONS

International Search Report and Written Opinion of PCT Application No. PCT/US2010/044698 dated Mar. 21, 2011.
International Search Report and Written Opinion of PCT Application No. PCT/US2010/044640 dated Mar. 23, 2011.
International Search Report and Written Opinion of PCT Application No. PCT/US2010/044664 dated Mar. 30, 2011.
Anonymous, "PCD Hammer Bit Inserts," Guilin Color Engineered Diamond Technology (EDT) Co., Ltd., retrieved Jan. 6, 2010, www.guilinedt.com, www.heavendiamonds.com.
Third Party Reference Submission of Australian Application No. 2010279358 dated Apr. 24, 2013: pp. 1-13.
Third Party Reference Submission of Australian Application No. 2010279280 dated Apr. 24, 2013: pp. 1-9.
Third Party Reference Submission of Australian Application No. 2010279295 dated Apr. 24, 2013: pp. 1-12.

* cited by examiner

HIGHLY WEAR RESISTANT DIAMOND INSERT WITH IMPROVED TRANSITION STRUCTURE

CROSS-REFERENCE TO RELATED APPLICATIONS

This application is a continuation application of U.S. patent application Ser. No. 12/851,874, filed on Aug. 6, 2012, which claims priority to U.S. Patent Application No. 61/232,125, filed on Aug. 7, 2009, the contents of which are herein incorporated by reference in their entirety.

BACKGROUND

1. Field

Embodiments disclosed herein relate generally to polycrystalline diamond enhanced inserts for use in drill bits, such as roller cone bits and hammer bits, in particular. More specifically, the disclosure relates to polycrystalline diamond enhanced inserts having an outer layer and at least one transition layer.

2. Background Art

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

There are several types of drill bits, including roller cone bits, hammer bits, and drag bits. Roller cone rock bits include a bit body adapted to be coupled to a rotatable drill string and include at least one "cone" that is rotatably mounted to a cantilevered shaft or journal as frequently referred to in the art. Each roller cone in turn supports a plurality of cutting elements that cut and/or crush the wall or floor of the borehole and thus advance the bit. The cutting elements, either inserts or milled teeth, contact with the formation during drilling. Hammer bits are typically include a one piece body with having crown. The crown includes inserts pressed therein for being cyclically "hammered" and rotated against the earth formation being drilled.

Depending on the type and location of the inserts on the bit, the inserts perform different cutting functions, and as a result also, also experience different loading conditions during use. Two kinds of wear-resistant inserts have been developed for use as inserts on roller cone and hammer bits: tungsten carbide inserts and polycrystalline diamond enhanced inserts. Tungsten carbide inserts are formed of cemented tungsten carbide: tungsten carbide particles dispersed in a cobalt binder matrix. A polycrystalline diamond enhanced insert typically includes a cemented tungsten carbide body as a substrate and a layer of polycrystalline diamond ("PCD") directly bonded to the tungsten carbide substrate on the top portion of the insert. An outer layer formed of a PCD material can provide improved wear resistance, as compared to the softer, tougher tungsten carbide inserts.

The layer(s) of PCD conventionally include diamond and a metal in an amount of up to about 20 percent by weight of the layer to facilitate diamond intercrystalline bonding and bonding of the layers to each other and to the underlying substrate. Metals employed in PCD are often selected from cobalt, iron, or nickel and/or mixtures or alloys thereof and can include metals such as manganese, tantalum, chromium and/or mixtures or alloys thereof. However, while higher metal content typically increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, typically brittleness also increases, thereby reducing the toughness of the PCD material.

Although the polycrystalline diamond layer is extremely hard and wear resistant, a polycrystalline diamond enhanced insert may still fail during normal operation. Failure typically takes one of three common forms, namely wear, fatigue, and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. Excessively high contact stresses and high temperatures, along with a very hostile downhole environment, also tend to cause severe wear to the diamond layer. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for swilling, chipping, or catastrophic failure of the enhanced insert.

External loads due to contact tend to cause failures such as fracture, spalling, and chipping of the diamond layer. Internal stresses, for example thermal residual stresses resulting from the manufacturing process, tend to cause delamination between the diamond layer and the substrate or the transition layer, either by cracks initiating along the interface and propagating outward, or by cracks initiating in the diamond layer surface and propagating catastrophically along the interface.

The impact, wear, and fatigue life of the diamond layer may be increased by increasing the diamond thickness and thus diamond volume. However, the increase in diamond volume result in an increase in the magnitude of residual stresses formed on the diamond/substrate interface that foster delamination. This increase in the magnitude in residual stresses is believed to be caused by the difference in the thermal contractions of the diamond and the carbide substrate during cool-down after the sintering process. During cool-down after the diamond bodies to the substrate, the diamond contracts a smaller amount than the carbide substrate, resulting in residual stresses on the diamond/substrate interface. The residual stresses are proportional to the volume of diamond in relation to the volume of the substrate.

The primary approach used to address the delamination problem in convex cutter elements is the addition of transition layers made of materials with thermal and elastic properties located between the ultrahard material layer and the substrate, applied over the entire substrate protrusion surface. These transition layers have the effect of reducing the residual stresses at the interface and thus improving the resistance of the inserts to delamination.

Transition layers have significantly reduced the magnitude of detrimental residual stresses and correspondingly increased durability of inserts in application. Nevertheless, basic failure modes still remain. These failure modes involve complex combinations of three mechanisms, including wear of the PCD, snake initiated fatigue crack growth, and impact-initiated failure.

It is, therefore, desirable that an insert structure be constructed, that provides desired PCD properties of hardness and wear resistance with improved properties of fracture toughness and chipping resistance, as compared to conventional PCD materials and insert structures, for use in aggressive cutting and/or drilling applications.

SUMMARY

In one aspect, embodiments disclosed herein relate to an insert for a drill bit that may include a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least one transition layer between the metallic carbide body and the outer layer, the at least one transition layer comprising a composite of second diamond grains, first metal carbide particles, and a second binder material, wherein the first metal carbide particles form a matrix in which the second diamond grains are dispersed, wherein the first metal carbide particles are present in the at least one transition layer in an amount ranging from about 15 to 50 volume percent.

In another aspect, embodiments disclosed herein relate to a cutting element that may include a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least one transition layer between the metallic carbide body and the outer layer, the at least one transition layer comprising a composite of second diamond grains, first metal carbide particles, and a second binder material, wherein the second diamond grains have a smaller grain size than the first diamond grains wherein the first diamond grains have a grain size of at least about 10 microns.

In yet another aspect, embodiments disclosed herein relate to a drill bit that may include a bit body and at least one cutting element attached to the bit body, the at least one cutting element including a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least one transition layer between the metallic carbide body and the outer layer, the at least one transition layer comprising a composite of second diamond grains, first metal carbide particles, and a second binder material, wherein the second diamond grains have a larger grain size than the first diamond grains.

In another aspect, embodiments disclosed herein relate to a drill bit that may include a bit body and at least one cutting element attached to the bit body, the at least one cutting element including a metallic, carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least one transition layer between the metallic carbide body and the outer layer, the at least one transition layer comprising a composite of second diamond grains, first metal carbide particles, and a second binder material, wherein the second diamond grains have a smaller grain size than the first diamond grains.

Other aspects and advantages of the disclosure will be apparent from the following description and the appended claims.

DETAILED DESCRIPTION

In one aspect, embodiments disclosed herein relate to polycrystalline diamond enhanced inserts for use in drill bits, such as roller cone bits and hammer bits. More specifically, embodiments disclosed herein relate to polycrystalline diamond enhanced inserts having a polycrystalline diamond outer layer and at least one transition layer. Whereas a conventional approach to achieving a balance between hardness/wear resistance with toughness involves varying the formulation of materials (diamond, metal, carbides) used to form the polycrystalline diamond layer, embodiments of the present disclosure consider the entire insert structure, including selection of the outer layer in combination with selection of the at least one transition layer possessing a transition in at least one of the formulation components. In particular, embodiments of the present disclosure rely on a gradient in the diamond grain size between the outer layer and at least one transition layer.

Figure 3:
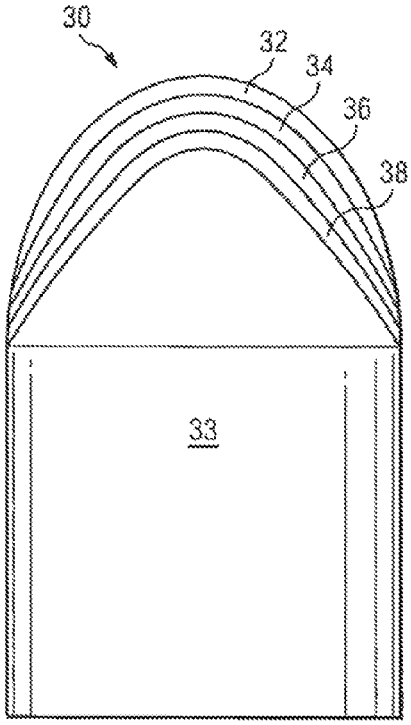
FIG. 3 shows a cutting element in accordance with one embodiment of the present disclosure.

Referring to FIG. 3, a cutting element in accordance with one embodiment of the present disclosure is shown. As shown in FIG. 3, a cutting element 30 includes a polycrystalline diamond outer layer 32 that forms the working or exposed surface for contacting the earth formation or other substrate to be cut. Under the polycrystalline diamond outer layer 32, three transition layers, an outer transition layer 34, an intermediate transition layer 36, and an inner transition layer 38, are disposed between the polycrystalline diamond layer 32 and substrate 33. While three transition layers are shown in FIG. 3, some embodiments may only include one or two transition layers or may include more than three transition layers.

The polycrystalline diamond layer may include a body of diamond particles bonded together to form a three-dimensional diamond network where a metallic phase may be present in the interstitial regions disposed between the diamond particles. In particular, as used herein, "polycrystalline diamond" or "a polycrystalline diamond material" refers to this three-dimensional network or lattice of bonded together diamond grains. Specifically, the diamond to diamond bonding is catalyzed by a metal (such as cobalt) by a high temperature/high pressure process, whereby the metal remains in the regions between the particles. Thus, the metal particles added to the diamond particles may function as a catalyst and/or binder, depending on the exposure to diamond particles that can be catalyzed as well as the temperature/pressure conditions. For the purposes of this application, when the metallic component is referred to as a metal binder, it does not necessarily mean that no catalyzing function is also being performed, and when the metallic component is referred to as a metal catalyst, it does not necessarily mean that no binding function is also being performed.

The at least one transition layer may include composites of diamond grains, a metal binder, and metal carbide or carbonitride particles. One skilled in the art should appreciate after learning the teachings of the present disclosure contained this application that the relative amounts of diamond and metal carbide or carbonitride particles may indicate the extent of diamond-to-diamond bonding within the layer. Conventionally, the use of transition layer(s) is to allow for a gradient in the diamond content between the outer layer and the transition layer(s), decreasing from the outer layer moving towards the insert body, coupled with a metal carbide content that increases from the outer layer moving towards the insert body.

However, in addition to the use of a gradient in diamond/metal carbide content between the outer layer and transition layer(s), embodiments of the present disclosure provide for a gradient in the diamond grain size between the layers and/or a gradient in the tungsten carbide pocket and/or grain size between the layers. Thus, between the outer layer and the at least one transition layer, there exists a difference in one or more of diamond content, carbide content, diamond grain size, and tungsten carbide grain and/or pocket size. In a particular embodiment, there exists a difference in each of diamond content, carbide content, and diamond grain size. In a different particular embodiment, there exists a difference in each of diamond content, carbide content, diamond grain size, and tungsten carbide pocket and/or grain size, it is also within the scope of the present disclosure that there may be included a gradient in the binder content between the layers.

When using multiple transition layers, the gradient may be provided between the outer layer and at least one of the transition layers. Thus, it is within the scope of the present disclosure that in an embodiment that includes three transition layers, the diamond gradient may exist at least between the outer layer and the outer transition layer, where the intermediate transition layer and inner transition layer may independently be selected to have the same or gradient diamond grain size, as compared to the outer transition layer. Alternatively, the gradient may exist within the outer layer and the intermediate transition layer (with the outer transition layer having an average diamond grain size and/or average tungsten carbide grain and/or pocket size substantially the same as the outer layer).

In various embodiments, the gradient in the diamond grain size may result in an increase in the diamond grain size, as moving from the outer transition layer towards the insert body/substrate. It is theorized by the inventors of the present disclosure that the increase in diamond grain size may produce an even tougher transition layer (as compared to a transition layer having the same diamond grain size) due to the difference in distribution of the metallic phase interdispersed in the diamond structure. In particular, there is a proportional relationship between grain size and toughness and an inverse relationship between grain size and strength. Fine grain size PCD generally has high strength and low toughness, while coarse grain PCD generally has high toughness and low strength. A coarser diamond grain structure may reduce the diamond surface area and increase the size of the binder pockets, which may be a favorable structure for improved toughness and impact resistance. The combination of such a tough transition layer with a highly wear resistant outer layer results in a total insert structure that improves the stiffness and toughness of the diamond insert while maintaining abrasion resistance.

Thus, for example, the average diamond grain size used to form the polycrystalline diamond outer layer may broadly range from about 2 to 30 microns in one embodiment, less than about 20 microns in another embodiment, and less than about 15 microns in yet another embodiment. However, in various other particular embodiments, the average grain size may range from about 2 to 8 microns, from about 4 to 8 microns, from about 10 to 12 microns, or from about 10 to 20 microns. It is also contemplated that other particular narrow ranges may be selected within the broad range, depending on the particular application and desired properties of the outer layer. Further, it is also within the present disclosure that the particles need not be unimodal, but may instead be bi- or otherwise multi-modal. Depending on the average grain size selected for the outer layer, the grain size of the at least one transition layer may be selected to be greater than that of the outer layer, in one embodiment.

However, while the above discussion describes the use of a diamond grain size that increases when moving from the outer layer to at least one transition layer (towards to the insert body/substrate), it is also within the scope of the present disclosure that a larger grain size may be present in the outer diamond layer than at least one transition layer. For example, a coarser diamond grade outer layer used in combination with at least one transition layer having a finer diamond grade may result in a shrinking differential between the two layers during the cool-down after sintering. Specifically, use of an outer layer having coarser diamond grains (as compared to an adjacent transition layer) may result in greater shrinkage of the transition layer (as compared to the outer layer), putting the outer layer in compression. In such an embodiment, it may be optional to include more than one transition layers that may have a diamond grain size coarser than that of the fine diamond grain transition layer.

As described above, in addition to diamond forming the microstructure of the polycrystalline diamond layer, the three-dimensional microstructure may also include a metal binder or catalyst), and optionally metal carbide, disposed in the interstitial regions of the network of diamond. In a particular embodiment, the metal binder may be present in the polycrystalline diamond outer layer in an amount that is at least about 3 volume percent. In other specific embodiments, the metal binder may be present in an amount that ranges between about 3 and 10 volume percent, is at least about 5 volume percent, or is at least about 8 volume percent. The metal binder content for a particular outer layer may be based upon, for example, the diamond grain size and the presence/amount of metal carbide in the layer. Generally, PCD with liner diamond grains may have greater abrasion resistance but lower toughness, thus, it may be desirable to increase the binder content for layers having liner grains to increase the toughness. Conversely, when using coarser diamond grains, i.e., greater than 10 microns, a layer may receive some toughness by virtue of the larger diamond grain size and thus there may be less need of the metal binder. However, it is also possible that more or less binder may be used depending on the desired properties of the layer. In a particular embodiment in which the diamond grains in at least one transition layer are greater than those of the outer layer, it may be desirable for the outer layer to have at least 91.5 volume percent, and at least 93 volume percent in another embodiment. Further, in an embodiment in which the diamond grains in at least one transition layer are smaller than those of the outer layer, it may be desirable for the outer layer to have no more than 90.5 volume percent, at no more than 89 volume percent in another embodiment.

Thus, it is also within the scope of the present disclosure that the polycrystalline diamond outer layer may include a composite of diamond and metal carbide (or carbonitride), with the metal catalyst/binder. In embodiments that include a metal carbide in the outer layer, those embodiments may include at most about 40 volume percent, at most about 9 volume percent of a metal carbide in another embodiment, less than about 7 volume percent of a metal carbide in other embodiments, and less than about 3 volume percent of a metal carbide in yet other embodiments. Those types of particles may include carbide or carbonitride particles of tungsten, tantalum, titanium, chromium, molybdenum, vanadium, niobium, hafnium, zirconium, or mixtures thereof. When using tungsten carbide, it is within the scope of the present disclosure that such particles may include cemented tungsten carbide (WC/Co), tungsten carbide (WC), cast tungsten carbide ($WC/W_2C$), or a plasma sprayed alloy of tungsten carbide and cobalt (WC—Co), which may collectively referred to as tungsten carbide powder. In a particular embodiment, for both the outer layer and transition layer(s), either cemented tungsten carbide or tungsten carbide may be used, with average powder grain size ranges of, for example, less than about 15 microns, less than about 6 microns, less than about 2 microns in another exemplary embodiment, less than about 1 micron in yet another exemplary embodiment, and ranging from about 0.5 to 3 microns in yet another embodiment. In a more particular embodiment, when the powder is formed of cemented tungsten carbide particles, the cemented tungsten carbide particles may be formed from individual tungsten carbide grains having an average grain size of less than about 2 microns, or less than about 1 micron in a more particular embodiment. In an alternative embodiment, when the powder is formed from tungsten carbide particles, those tungsten carbide particles may have an average grain size of less than about 1 microns, or less than about 1 micron in a more particular embodiment. In other embodiments, the one or more transition layers may include larger powder and/or tungsten carbide grain sizes.

During mixing and/or HPHT sintering, the carbide powder may agglomerate and join together during HPHT sintering to fill the space between diamond grains. These agglomerates may be referred herein to as "pockets" of tungsten carbide in the microstructure. In the outer layer, in a uniform microstructure, in one embodiment, the size of agglomerated carbide particles, i.e., carbide pockets, may depend on the size of the average powder size, but in a particular embodiment, the size of the agglomerated carbide grains may be less than the grain size of the diamond or in particular embodiment, may be less than 5 microns, less than 2 microns in a more particular embodiment, or ranging from about 1 to 2 microns in an even more particular embodiment. In the first transition layer, in a uniform microstructure, in one embodiment, the average pocket size of carbide may be greater than 10 microns, with the pocket size generally ranging from about 5-300 microns, with an average pocket size of about 10-30 microns in a more particular embodiment. In subsequent transition layer, as the volume percent of carbide increases, the carbide particles may form a matrix in which the diamond grains are dispersed, rather than pockets within a diamond matrix. However, carbide size may ultimately be selected based on desired properties of the layer(s) as well as the other layer components.

In one embodiment, the powder selection between the outer layers and one or more transition layers may be the same; however, in another embodiment, the powder size for the one or transition layers may be greater than the powder size for the outer layer. Alternatively, a gradient in the powder size may exist between the outer layer and the intermediate or inner transition layer (with the outer transition layer having an powder size substantially the same as the outer layer).

It is well known that various metal carbide or carbonitride compositions and binders may be used in addition to tungsten carbide and cobalt. Thus, references to the use of tungsten carbide and cobalt in the transition layers are for illustrative purposes only, and no limitation on the type of metal carbide/carbonitride or binder used in the transition layer is intended. When cemented tungsten carbide particles are used, the metal content in the particles may range, for example, from 4 to 8 weight percent, but may be greater than 8 or less than 4 weight percent depending on the desired properties of the layer in which they are incorporated.

The polycrystalline diamond outer layer may have a thickness of at least 0.006 inches in one embodiment, and at least 0.020 inches or 0.040 inches in other embodiments. In particular embodiments, the polycrystalline diamond outer layer may have a lesser thickness than the at least one transition layer. Selection of thicknesses of the diamond outer layer and the at least one transition layer may depend, for example, on the particular layer formulations, as described in U.S. Patent Application 61/232,122, filed Aug. 7, 2009, entitled "Diamond and Transition Layer Construction with Improved Thickness Ratio", filed concurrently herewith, assigned to the present assignee and herein incorporated by reference in its entirety. However, depending on the particular layer formulations, it may also be desirable for the outer layer to have a greater thickness than at least one transition layer.

As used herein, the thickness of any polycrystalline diamond layer refers to the maximum thickness of that layer, as the diamond layer may vary in thickness across the layer. Specifically, as shown in U.S. Pat. No. 6,199,645, which is herein incorporated by reference in its entirety, it is within the scope of the present disclosure that the thickness of a polycrystalline diamond layer may vary so that the thickness is greatest within the critical zone of the cutting element. It is expressly within the scope of the present disclosure that a polycrystalline diamond layer may vary or taper such that it has a non-uniform thickness across the layer. Such variance in thickness may generally result from the use of non-uniform upper surfaces of the insert body/substrate in creating a non-uniform interface.

The at least one transition layer may include composites of diamond grains, a metal binder, and carbide or carbonitride particles, such as carbide or carbonitride particles of tungsten, tantalum, titanium, chromium, molybdenum, vanadium, niobium, hafnium, zirconium, or mixtures thereof, which may include angular or spherical particles. When using tungsten carbide, it is within the scope of the present disclosure that such particles may include cemented tungsten carbide (WC/Co), stoichiometric tungsten carbide (WC), cast tungsten carbide ($WC/W_2C$), or a plasma sprayed alloy of tungsten carbide and cobalt (WC—Co). The size ranges of carbides in the transition layer(s) may include those described above with respect to the outer layer. Further, it is well known that various metal carbide or carbonitride compositions and binders may be used in addition to tungsten carbide and cobalt. Thus, references to the use of tungsten carbide and cobalt in the transition layers are for illustrative purposes only, and no limitation on the type of metal carbide/carbonitride or binder used in the transition layer is intended.

The carbide (or carbonitride) amount present in the at least one transition may vary between about 15 and 80 volume percent of the at least one transition layer. As discussed above, the use of transition layer(s) may allow for a gradient in the diamond and carbide content between the outer layer and the transition layer(s), the diamond decreasing from the outer layer moving towards the insert body, coupled with the metal carbide content increasing from the outer layer moving towards the insert body. Thus, depending on the number of transition layers used, the carbide content of a particular layer may be determined. For example, the outer transition layer may possess a carbide content in the range of 15-35 volume percent, 20-40 volume percent, or less than 40 volume percent, while an intermediate layer may have a greater carbide content, such as in the range of 35-55 volume percent, 35-50 volume percent, 40-50-volume percent, or less than 60 volume percent. An innermost transition layer may have an even greater carbide content, such as in the range of 55-75 volume percent, 60-80 volume percent, 50-70 volume percent, or less than 80 volume percent. However, no limitation exists on the particular ranges. Rather, any range may used in forming the carbide gradient between the layers.

The metal binder content in the at least one transition layer may be in an amount that is at least about 5 volume percent, and between 5 and 20 volume percent in other particular embodiments. Selection of metal binder content for transition layer(s) may depend, for example, in part on the diamond grain size, the desired toughness, the desired gradient, and binding function.

Further, as discussed above, particular embodiments may possess a gradient in the diamond grain size that results in an increase in the diamond grain size, as moving from the outer transition layer towards the insert body/substrate. Thus, while the diamond grain size of the polycrystalline diamond outer layer may broadly range from 2 to 30 microns, the selection of the diamond grain size of the at least one transition layers depends on that selected for the outer layer, but may broadly range, for example, from 4 to 50 microns.

The presence of at least one transition layer between the polycrystalline diamond outer layer and the insert body/substrate may create a gradient with respect to thermal expansion coefficients and elasticity, minimizing a sharp change in thermal expansion coefficient and elasticity between the layers that would otherwise contribute to cracking, and chipping of the PCD layer from the insert body/substrate.

It is also within the scope of the present disclosure that the cuttings elements may include a single transition layer, with a gradient in the diamond/carbide content within the single transition layer. The gradient within the single transition layer may be generated by methods known in the art, including those described in U.S. Pat. No. 4,694,918, which is herein incorporated by reference in its entirety.

The insert body or substrate may be formed from a suitable material such as tungsten carbide, tantalum carbide, or titanium carbide. In the substrate, metal carbide grains are supported by a matrix of a metal binder. Thus, various binding metals may be present in the substrate, such as cobalt, nickel, iron, alloys thereof, or mixtures, thereof. In a particular embodiment, the insert body or substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes only, and no limitation on the type of carbide or binder use is intended.

As used herein, a polycrystalline diamond layer refers to a structure that includes diamond particles held together by intergranular diamond bonds, formed by placing an unsintered mass of diamond crystalline particles within a metal enclosure of a reaction cell of a HPHT apparatus and subjecting individual diamond crystals to sufficiently high pressure and high temperatures (sintering under HPHT conditions) that intercyrstalline bonding occurs between adjacent diamond crystals. A metal catalyst, such as cobalt or other Group VIII metals, may be included with the unsintered mass of crystalline particles to promote intercrystalline diamond-to-diamond bonding. The catalyst material may be provided in the form of powder and mixed with the diamond grains, or may be infiltrated into the diamond grains during HPHT sintering.

The reaction cell is then placed under processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD.

The transition layers may similarly be formed by placing an unsintered mass of the composite material containing diamond particles, tungsten carbide and cobalt within the HPHT apparatus. The reaction cell is then placed under processing conditions sufficient to cause sintering of the material to create the transition layer. Additionally, a preformed metal carbide substrate may be included. In which case, the processing conditions can join the sintered crystalline particles to the metal carbide substrate. Similarly, a substrate having one or more transition layers attached thereto may be used in the process to add another transition layer or a polycrystalline diamond layer. A suitable HPHT apparatus for this process is described in U.S. Pat. Nos. 2,947,611; 2,941,241; 2,941,248; 3,609,818; 3,767,371; 4,289,503; 4,673,414; and 4,954,139.

An exemplary minimum temperature is about 1200° C., and an exemplary minimum pressure is about 35 kilobars. Typical processing is at a pressure of about 45-55 kilobars and a temperature of about 1300-1400° C. The minimum sufficient temperature and pressure in a given embodiment may depend on other parameters such as the presence of a catalytic material, such as cobalt. Typically, the diamond crystals will be subjected to the HPHT sintering the presence of a diamond catalyst material, such as cobalt, to form an integral, tough, high strength mass or lattice. The catalyst, e.g., cobalt, may be used to promote recrystallization of the diamond particles and formation of the lattice structure, and thus, cobalt particles are typically found within the interstitial spaces in the diamond lattice structure. Those of ordinary skill will appreciate that a variety of temperatures and pressures may be used, and the scope of the present disclosure is not limited to specifically referenced temperatures and pressures.

Application of the HPHT processing will cause diamond crystals to sinter and form a polycrystalline diamond layer. Similarly, application of HPHT to the composite material will cause the diamond crystals and carbide particles to sinter such that the are no longer in the form of discrete particles that can be separated from each other. Further, all of the layers bond to each other and to the substrate during the HPHT process.

It is also within the scope of the present disclosure that the polycrystalline diamond outer layer may have at least a portion of the metal catalyst removed therefrom, such as by leaching the diamond layer with a leaching agent (often a strong acid). In a particular embodiment, at least a portion of the diamond layer may be leached in order to gain thermal stability without losing impact resistance.

It is desired that such composite material display such improved properties without adversely impacting the inherent PCD property of wear resistance. It is desired that such composite material be adapted for use in such applications as cutting, tools, roller cone bits, percussion or hammer bits, drag bits and other mining, construction and machine applications, where properties of improved fracture toughness is desired.

Exemplary Embodiments

The following examples are provided in table form to aid in demonstrating the variations that may exist in the insert layer structure in accordance with the teachings of the present disclosure. Additionally, while each example is indicated to an outer layer with three transition layers, it is also within the present disclosure that more or less transition layers may be included between the outer layer and the carbide insert body (substrate). These examples are not intended to be limiting, but rather one skilled in the art should appreciate that further insert layer structure variations may exist within the scope of the present disclosure.

Example 1

| Layer | Avg grain size (μm) | Binder % vol | WC % vol |
|---|---|---|---|
| outer | 2-8 | ≥3 | <3 |
| second | 5-15 | >5 | 15-35 |
| third | 5-15 | >5 | 35-60 |
| fourth | 5-15 | >5 | 60-80 |

Example 2

| Layer | Avg grain size (μm) | Binder % vol | WC % vol |
|---|---|---|---|
| outer | 4-8 | ≥3 | <3 |
| second | 8-12 | >5 | 15-35 |
| third | 10-15 | >5 | 35-55 |
| fourth | 12-20 | >5 | 55-75 |

Example 3

| Layer | Avg grain size (μm) | Binder % vol | WC % vol |
|---|---|---|---|
| outer | 2-8 | ≥3 | <3 |
| second | 4-8 | >5 | 15-35 |
| third | 5-15 | >5 | 35-60 |
| fourth | 5-15 | >5 | 60-80 |

Example 4

| Layer | Avg grain size (μm) | Binder % vol | WC % vol |
|---|---|---|---|
| outer | 2-8 | ≥8 | ≤40 |
| second | 4-8 | >8 | ≤40 |
| third | 5-15 | >5 | ≤60 |
| fourth | 5-15 | >5 | ≤80 |

Example 5

| Layer | Avg grain size (μm) | Binder % vol | WC % vol |
|---|---|---|---|
| outer | 4-8 | ≥3 | ≤40 |
| second | 5-15 | >5 | ≤40 |
| third | 5-15 | >5 | ≤60 |
| fourth | 5-15 | >5 | ≤80 |

Example 6

| Layer | Avg grain size (μm) | Binder % vol | WC % vol |
|---|---|---|---|
| outer | 2-8 | ≥3 | ≤9 |
| second | 4-8 | >5 | 15-35 |
| third | 5-15 | >5 | 35-60 |
| fourth | 5-30 | >5 | 60-80 |

Example 7

| Layer | Avg grain size (μm) | Binder % vol | WC % vol |
|---|---|---|---|
| outer | 10-12 | 3-10 | <3 |
| second | 12-20 | >5 | 15-35 |
| third | 12-20 | >5 | 35-55 |
| fourth | 12-20 | >5 | 55-75 |

Example 8

| Layer | Avg grain size (μm) | Binder % vol | WC % vol |
|---|---|---|---|
| outer | 10-12 | 3-10 | <3 |
| second | 10-12 | >5 | 15-35 |
| third | 12-20 | >7 | 35-55 |
| fourth | 12-20 | >8 | 55-75 |

Example 9

| Layer | Avg grain size (μm) | Binder % vol | WC % vol |
|---|---|---|---|
| outer | 2-3 (30%) & 8-16 (70%) | ≥3 | <3 |
| second | 4-8 | >10 | 20-40 |
| third | 4-8 | >12 | 40-50 |
| fourth | 4-8 | >14 | 50-70 |

Example 10

| Layer | Avg grain size (μm) | Binder % vol | WC % vol |
|---|---|---|---|
| outer | 2-3 (30%) & 8-16 (70%) | >3 | <3 |
| second | 4-8 | >5 | 20-40 |
| third | 10-20 | >5 | 40-50 |
| fourth | 10-40 | >5 | 50-70 |

Example 11

| Layer | Avg grain size (μm) | Catalyst % vol | WC % vol |
|---|---|---|---|
| outer | 10-20 | 3-10 | <3 |
| second | 15-30 | >5 | 20-40 |
| third | 15-50 | >5 | 40-50 |
| fourth | 15-50 | >5 | 50-70 |

An insert made in accordance with the present disclosure was created to have an outer layer and three transition layers atop a carbide substrate, with the components in the resulting microstructure listed in Example 12, below. A comparative insert was created to also have at outer layer and two transition layers, with the components in the resulting microstructure listed in Example 13, below.

Example 12

| Layer | Avg grain size (μm) | Binder % vol | WC % vol | Avg WC pocket size (μm) |
|---|---|---|---|---|
| outer | 5 | 7 | 8 | 2 |
| second | 12 | 5 | 25 | 15 |
| third | 12 | 7 | 40 | continuous |
| fourth | 12 | 9 | 55 | continuous- |

Example 13

| Layer | Avg grain size (μm) | Binder % vol | WC % vol |
|---|---|---|---|
| outer | 5 | 9 | 0.5 |
| second | 5 | 9 | 35 |
| third | 5 | 11 | 50 |

Samples of each insert were subjected to a compressive fatigue test at a lower cyclic load at 20 Hz and an R ratio (min load/max load) of 0.1 with a target test life of 1,000,000 cycles. The number of cycles each sample achieved (to the target test life or to failure) are shown in Table 14 below.

TABLE 14

| Sample No. | Example 12 | Example 13 |
|---|---|---|
| 1 | 500,000 | 900,000 |
| 2 | 1,000,000 (no failure) | 500,000 |
| 3 | 1,000,000 (no failure) | 1,000,000 (no failure) |
| 4 | 1,000,000 (no failure) | 600,000 |
| 5 | 1,000,000 (no failure) | 600,000 |
| 6 | | 1,000,000 (no failure) |
| 7 | | 500,000 |
| 8 | | 100,000 |
| 9 | | 300,000 |
| 10 | | 200,000 |
| 11 | | 400,000 |
| 12 | | 100,000 |
| Average | 900,000 | 516,667 |

Figure 4:
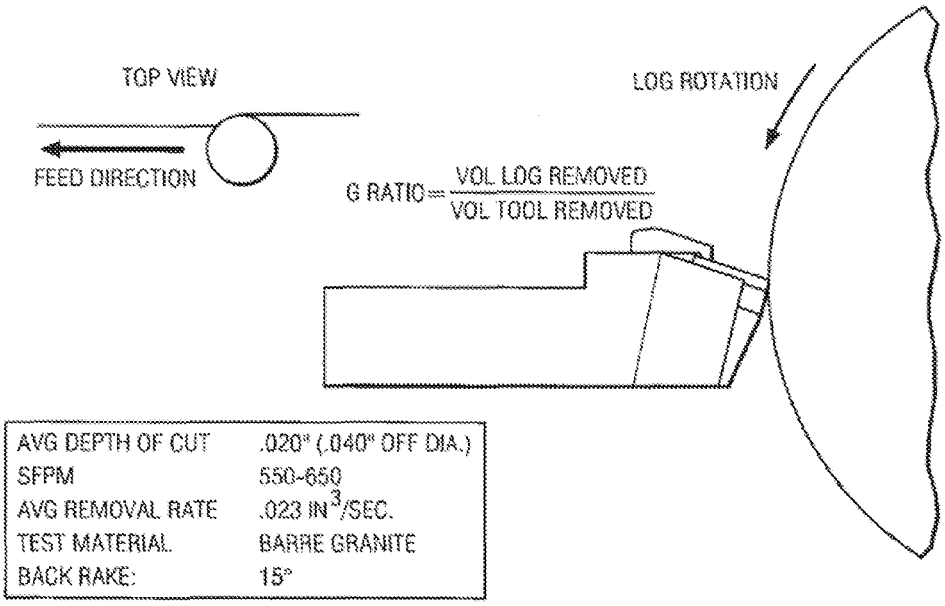
FIG. 4 shows a schematic of a test set-up for testing relative wear resistance.
Figure 5:
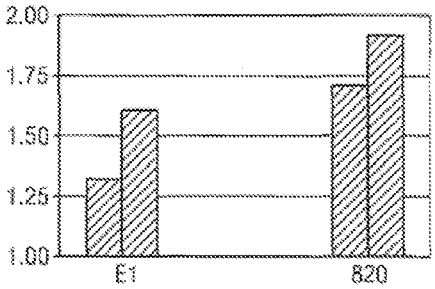
FIG. 5 shows the results of a relative wear resistance test.
Figure 6:
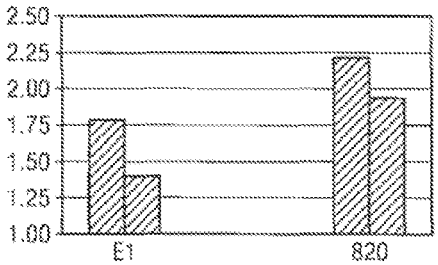
FIG. 6 shows the results of a relative wear resistance test.

Two samples of each insert were also subjected to relative wear resistance tests under flood cooling conditions. A schematic of the test set-up is shown in FIG. 4. The results of the relative wear test under flood cooling conditions are shown in FIG. 5. Two samples of each insert were also subjected to relative wear resistance tests under mist cooling conditions. The results of this test are shown in FIG. 6.

Figure 1:
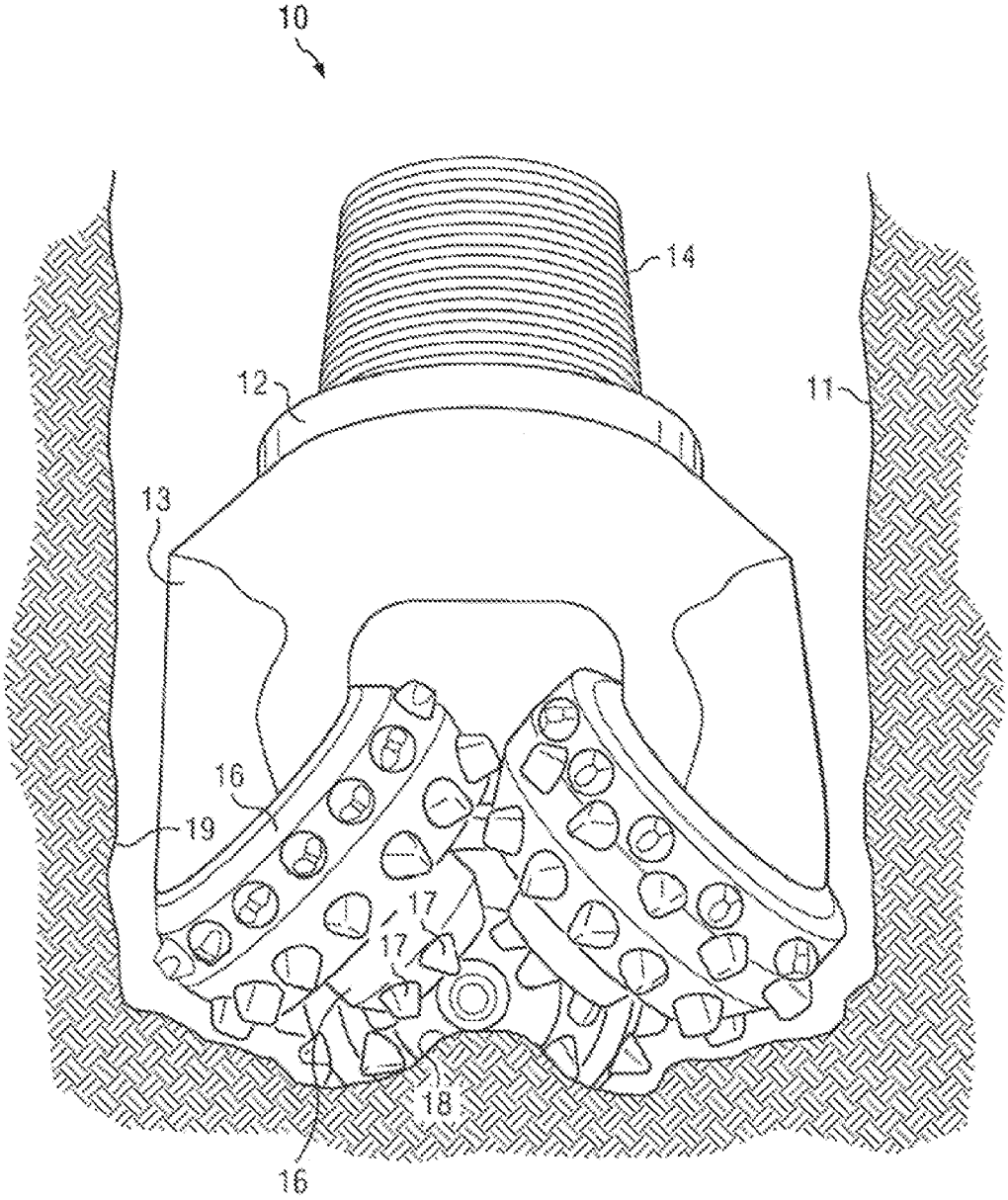
FIG. 1 shows a roller cone drill bit using a cutting element of the present disclosure.

The cutting elements of the present disclosure may find particular use in roller cone bits and hammer bits. Roller cone rock bits include a bit body adapted to be coupled to a rotatable drill string and include at least one "cone" that is rotatably mounted to the bit body. Referring to FIG. 1, a roller cone rock bit 10 is shown disposed in a borehole 11. The bit 10 has a body 12 with legs 13 extending generally downward, and a threaded pin end 14 opposite thereto for attachment to a drill string (not shown). Journal shafts (not shown) are cantilevered from legs 13. Roller cones (or rolling cutters) 16 are rotatably mounted on journal shafts. Each roller cone 16 has a plurality of cutting elements 17 mounted thereon. As the body 10 is rotated by rotation of the drill string (not shown), the roller cones 16 rotate over the borehole bottom 18 and maintain the gage of the borehole by rotating against a portion of the borehole sidewall 19. As the roller cone 16 rotates, individual cutting elements 17 are rotated into contact with the formation and then out of contact with the formation.

Figure 2:
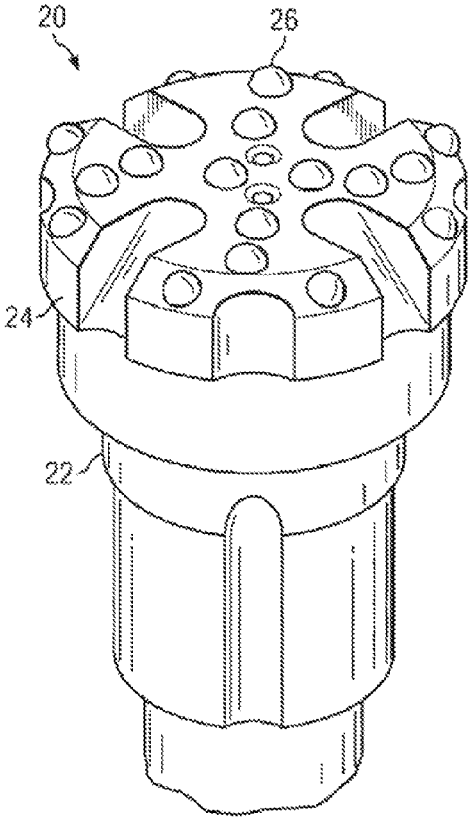
FIG. 2 shows a hammer bit using a cutting, element of the present disclosure.

Hammer bits typically are impacted by a percussion hammer while being rotated against the earth formation being drilled. Referring to FIG. 2, a hammer bit is shown. The hammer bit 20 has a body 22 with a head 24 at one end thereof. The body 22 is received in a hammer (not shown), and the hammer moves the head 24 against the formation to fracture the formation. Cutting elements 26 are mounted in the head 24. Typically the cutting elements 26 are embedded in the drill bit by press fitting or brazing into the bit.

The cutting inserts of the present disclosure may have a body having a cylindrical grip portion from which a convex protrusion extends. The grip is embedded in and affixed to the roller cone or hammer bit, and the protrusion extends outwardly from the surface of the roller cone or hammer bit. The protrusion, for example, may be hemispherical, which is commonly referred to as a semi-round top (SRT), or may be conical, or chisel-shaped, or may form a ridge that is inclined relative to the plane of intersection between the grip and the protrusion. In some embodiments, the polycrystalline diamond outer layer and one or more transition layers may extend beyond the convex protrusion and may coat the cylindrical grip. Additionally, it is also within the scope of the present disclosure that the cutting elements described herein may have a planar upper surface, such as would be used in a drag bit.

Embodiments of the present disclosure may provide at least one of the following advantages. In a typical drilling application, the outer diamond layer is subjected to impact cyclic loading. It is also typical for the diamond material to have multiple cracks that extend downward and inward. However, use of the layers of the present disclosure use a gradient in diamond grain size to result an insert structure that maintains the wear resistance of the outer layer while significantly boosting the toughness and stiffness of the entire insert through the transition layer(s). Additionally, the properties of the transition layer(s) may result in an equally tough layer, yet with greater wear resistance than conventional transition layers. Thus, while a conventional insert may quickly wear through a transition layer upon wearing through the outer layer, an insert formed in accordance with the embodiments of the present disclosure may possess a transition layer having a wear resistance more similar to an outer layer, thus resulting in slower wear through the transition layer upon wearing through the outer layer.

While the disclosure has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A cutting element comprising:

a metallic carbide body;

an outer layer of polycrystalline diamond material on the outermost end of the insert, the polycrystalline diamond material comprising a plurality of interconnected first diamond grains; a first binder material in interstitial regions between the interconnected first diamond grains, and a first metal carbide material; and at least one transition layer between the metallic carbide body and the outer layer, the at least one transition layer comprising a composite of second diamond grains, second metal carbide particles having an average grain size larger than the average grain size of the first metal carbide particles, and a second binder material, wherein the second metal carbide particles form a matrix in which the second diamond grains are dispersed, wherein the second metal carbide particles are present in the at least one transition layer in an amount ranging from about 15 to 30 volume percent.

2. The cutting element of claim 1, wherein the second diamond grains have a larger grain size than the first diamond grains.

3. The cutting element of claim 1, wherein the second binder material is present in the at least one transition layer in an amount ranging from 10 to 20 volume percent.

4. The cutting element of claim 1, wherein the at least one transition layer comprises two transition layers, a first transition layer adjacent the outer layer and a second transition layer adjacent the carbide body.

5. The cutting element of claim 4, wherein the second transition layer has a greater metal carbide content than the first transition layer.

6. The cutting element of claim 4, wherein the second transition layer has an average diamond grain size greater than the first transition layer.

7. The cutting element of claim 4, wherein the first and second transition layers have substantially the same average diamond grain size.

8. The cutting element of claim 1, wherein the first metal carbide particles and the second metal carbide particles comprise pre-cemented tungsten carbide particles.

9. A cutting element comprising:

a metallic carbide body;

an outer layer of polycrystalline diamond material on the outermost end of the insert, the polycrystalline diamond material comprising a plurality of interconnected first diamond grains, a first binder material in interstitial regions between the interconnected first diamond grains, and first metal carbide particles; and at least one transition layer between the metallic carbide body and the outer layer, the at least one transition layer comprising a composite of second diamond grains, second metal carbide particles, and a second binder material, wherein the second diamond grains have a smaller grain size than the first diamond grains, wherein the first diamond grains have a grain size of at least about 10 microns, and wherein each of the at least one transition layer has a greater metal carbide content than the outer layer.

10. The cutting element of claim 9, wherein the at least one transition layer comprises two transition layers, a first transition layer adjacent the outer layer and a second transition layer adjacent the carbide body.

11. The cutting element of claim 10, wherein the second transition layer has a greater metal carbide content than the first transition layer.

12. The cutting element of claim 10, wherein the second transition layer has an average diamond grain size greater than the first transition layer.

13. The cutting element of claim 10, wherein the first and second transition layers have substantially the same average diamond grain size.

14. The cutting element of claim 9, wherein the first diamond grains have an average grain size of at least about 20 microns.

15. The cutting element of claim 9, wherein the first metal carbide particles in the outer layer form pockets having an average pocket size smaller than an average pocket size of pockets formed by the second metal carbide particles in the at least one transition layer.

16. The cutting element of claim 15, wherein the pockets of the first metal carbide particles have an average pocket size of less than 5 microns.

17. The cutting element of claim 15, wherein the pockets of the second metal carbide particles in at least one transition layer have a pocket size of ranging from about 5-300 microns.

18. The cutting element of claim 17, wherein the pockets of the second metal carbide particles have an average pocket size of ranging from about 10-30 microns.

19. The cutting element of claim 9, wherein the first metal carbide particles in the outer layer have a smaller grain size than the first second metal carbide particles in the at least one transition layer.

20. The cutting element of claim 9, wherein the second metal carbide particles and the first metal carbide particles comprise pre-cemented tungsten carbide particles.

21. A drill bit, comprising:

a bit body; and at least one cutting element attached to the bit body, wherein the at least one bit body comprises:

a metallic carbide body;

an outer layer of polycrystalline diamond material on the outermost end of the insert, the polycrystalline diamond material comprising a plurality of interconnected first diamond grains, a first binder material in interstitial regions between the interconnected first diamond grains, and first metal carbide particles; and at least one transition layer between the metallic carbide body and the outer layer, the at least one transition layer comprising a composite of second diamond grains, second metal carbide particles, and a second binder material, wherein the second diamond grains have a larger grain size than the first diamond grains or wherein the second diamond grains have a smaller grain size than the first diamond grains, and wherein the second metal carbide particles have a larger grain size than the first metal carbide particles.

* * * * *